United States Patent [19]

Robertson

[11] 4,039,363

[45] Aug. 2, 1977

[54] METHOD OF MAKING FLOATING SEAT CUSHION

[76] Inventor: James H. Robertson, P.O. Box 9551, North Hollywood, Calif. 91609

[21] Appl. No.: 723,038

[22] Filed: Sept. 13, 1976

[51] Int. Cl.[2] ..... B32B 31/00

[52] U.S. Cl. ..... 156/145; 156/290; 428/68; 428/12; 428/71; 428/76; 428/194; 428/311; 428/315

[58] Field of Search ..... 428/68, 69, 71, 76, 428/311, 315, 12, 189, 192, 194; 156/145, 290, 304, 306, 309

[56] References Cited

U.S. PATENT DOCUMENTS

| | | | |
|---|---|---|---|
| 2,660,194 | 11/1953 | Hoffman | 428/315 |
| 2,878,153 | 3/1959 | Hackländer | 5/347 |

FOREIGN PATENT DOCUMENTS

| | | | |
|---|---|---|---|
| 2,026,619 | 12/1971 | Germany | 428/311 |

*Primary Examiner*—William J. Van Balen
*Attorney, Agent, or Firm*—Robert C. Comstock

[57] ABSTRACT

A floating seat cushion which is capable of emergency use as a life preserver. The seat cushion comprises a center core of open cell polyurethane foam material surrounded by an outer layer of closed cell polyethylene foam material. A belt extends transversely adjacent one side of the center core to form a pair of loops which extend outwardly from opposite sides of the cushion. The belt is preferably laminated between the center core and outer layer. The cushion is preferably formed by placing the center core outer layer and belt in overlying relationship to each other with adhesive between them. The assembly is then placed in a press and compressed to cause the center core to collapse so that the peripheral portions of the outer layer can be bonded together to enclose the center core. Air is then replaced into the center core to cause the cushion to assume a convex or crown shape. The completed cushion is preferably coated with vinyl.

4 Claims, 3 Drawing Figures

METHOD OF MAKING FLOATING SEAT CUSHION

BACKGROUND OF THE INVENTION

1. Field of the Invention

The invention relates to a floating seat cushion for use on boats or around water as both a cushion and an emergency life preserver.

2. Description of the Prior Art

Floating seat cushions of the type now in use are filled with kapok, which is sealed inside plastic sleeves. Such cushions are comparatively bulky and unattractive in appearance, particularly in comparision with the smooth finish of products made with modern foam materials.

If the kapok should come into contact with gasoline, the kapok will immediately lose its buoyancy and the cushion becomes useless as a life preserver.

Floating seat cushions could possibly be formed from a block of closed cell flexible plastic material such as polyethylene, but the cost would be excessive because such materials are too expensive for practical use.

Open cell materials have the advantage of considerably lower cost and increased flexibility and softness, but they are permeable by water, which makes them unsuitable for use alone in life preservers or other articles which must float in water when in use.

Closed cell foam plastic material such as polystyrene do not have the degree of softness and flexibility which is desirable in a seat cushion, nor do they have the required durability. They can be easily chipped, cut and broken away.

SUMMARY OF THE INVENTION

The present invention provides a new type of floating seat cushion which is formed from a combination of foam plastic materials. The resulting product has the desired qualities of softness and comfort when in use as a cushion, together with being floatable when in emergency use as a life preserver and having strength and durability in both uses.

The floating seat cushion of the present invention has a better appearance, increased durability and quality of construction than comparable products of the type now in use.

It is a particular object of the present invention to provide an improved floating seat cushion of the type described in which a major portion of the cushion is formed of relatively low cost material, such as open cell polyurethane foam. This material is surrounded by an outer layer of substantially expensive flexible closed cell material.

A continuous belt of webbing material is incorporated into the cushion construction for use in throwing the cushion to a person in the water and for the person in the water to catch or take hold of the cushion.

The resulting seat cushion is capable of supporting a person weighing up to 200 lbs. in the water and meets the Coast Guard requirements for such products.

The present invention includes a novel method of forming a floating seat cushion in which the center core is deflated to permit the edges of the outer layer to be laminated together around their entire periphery to enclose the center core. The center core is then reinflated to provide the desired buoyancy and to provide a crown shape for the cushion.

It is accordingly among the objects of the invention to provide a new type of floating seat cushion having all of the advantages and benefits set forth above and described in further detail hereinafter in this specification.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE PREFERRED EMBODIMENT

Figure 1:
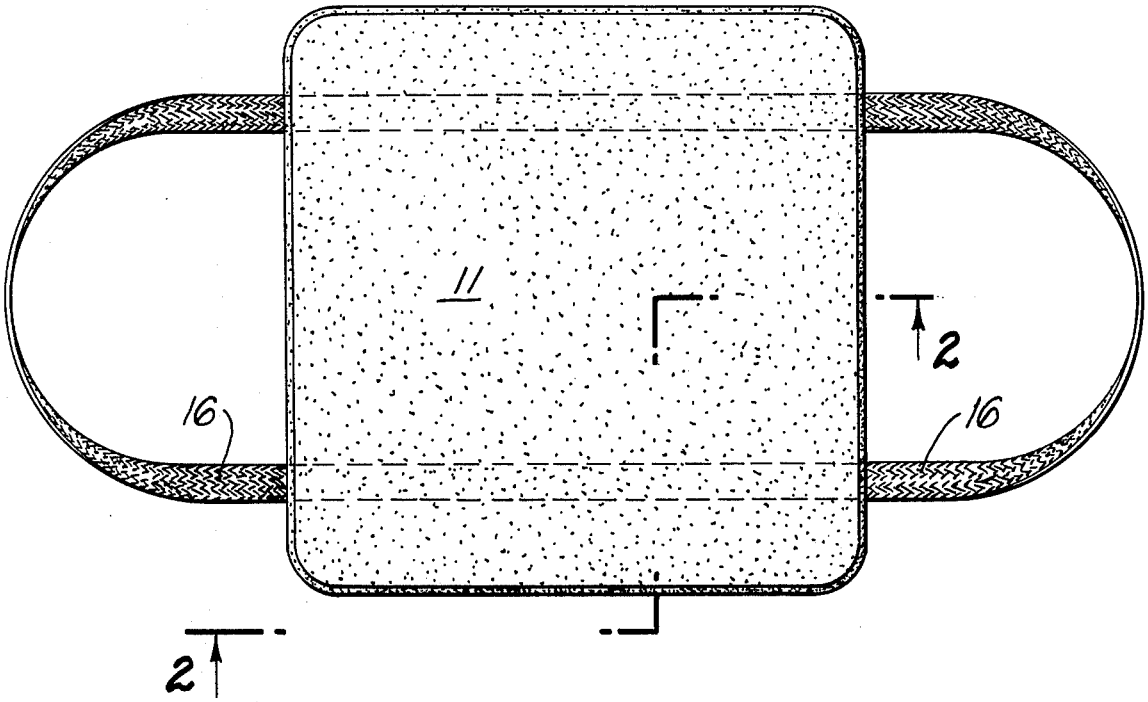
FIG. 1 is a top plan view of my floating seat cushion.
Figure 2:
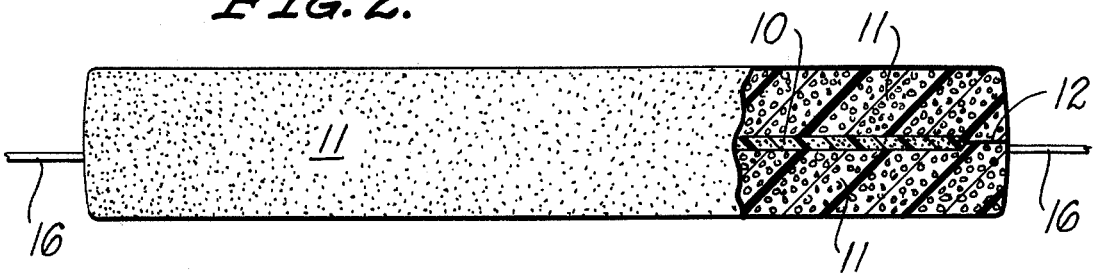
FIG. 2 is a partial elevational and partial sectional view taken on line 2—2 of FIG. 1, showing the center core collapsed, its thickness being exaggerated for purposes of illustration.
Figure 3:
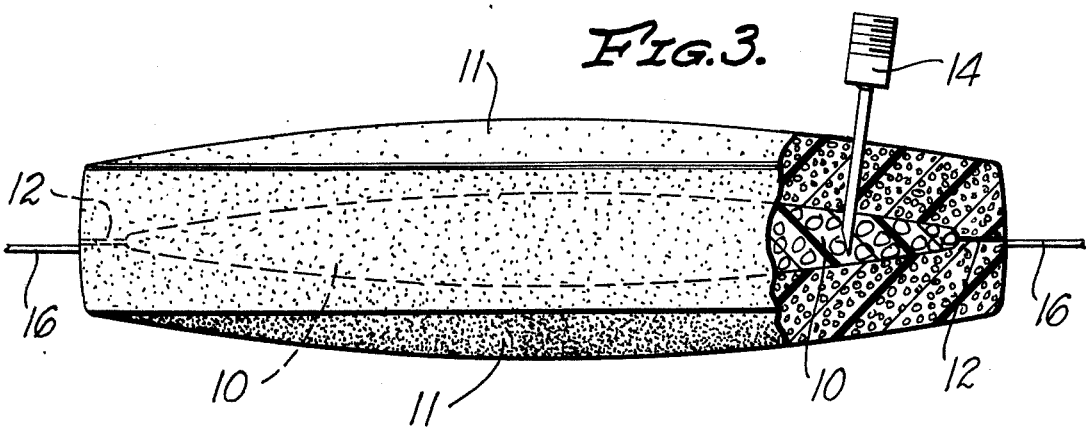
FIG. 3 is a view similar to FIG. 2, showing the center core re-inflated by a needle.

A preferred embodiment which has been selected to illustrate the invention comprises a center core 10, which may be approximately 1½ inches thick and which is preferably formed of relatively inexpensive open cell polyurethane foam material. The center core 10 may also be formed of other suitable foam material.

An outer layer 11, which may be approximately 1¼ inches thick, is preferably formed of closed call cross-linked polyethylene material or any other closed cell compressible foam such as vinyl or polyethylene.

The cushion is preferably constructed by cutting the foam material into substantially square blocks, with the outer layer being substantially longer in both length and width than the center core. The center core 10 is mounted centrally with respect to the two sides of the outer layer 11. The outer layer 11 is accordingly provided with peripheral portions 12 which extend around all four sides of the center core 10.

A belt 16, which may be formed of 1 inch wide polypropylene material, is attached to itself to form a continuous loop which is substantially longer than the seat cushion. The belt 16 is placed between one side of the center core 10 and the adjacent side of the outer layer 11. Suitable adhesive material is applied to the belt 16, to both sides of the center core 10 and to the inner sides of the outer layer 11, with epoxy resin preferably being used in areas of particular stress.

The entire assembly is then placed in a press and compressed in order to drive substantially all of the air out of the center core 10 and cause it to be collapsed virtually completely to a thickness of approximately 1/32 inch. This is equivalent to removing the center core 10 so that it will not interfere with the bonding of the adjacent peripheral portions 12 of the outer layer 11 when the adhesive coated peripheral portions 12 are pressed into engagement with each other.

The assembly is then cut by a die cutter, which cuts around corners and edges around the entire cushion, except for the areas where the belt 16 protrudes. These areas must be trimmed by hand in order to avoid cutting the belt 16.

After the pressing and die cutting are completed, the outer layer 11 completely encloses the center core in a substantially air tight manner. A hollow needle 14 is then inserted through the outer layer 11 into the center core 10. Air is drawn through the needle 14 from the atmosphere into the center core 10 to re-inflate it as much as is possible in view of the pressure which is exerted against its peripheral portions by the outer layer 11.

When inflated, the center core 10 assumes a convex shape, which in turn causes the top and bottom of the cushion to assume a convex or crown configuration. Such as crown shape is desirable to provide greater softness in the center of the cushion and to provide an attractive contour for the finished product.

It should be noted that the desired crown shape is achieved without the use of cutting or forming operations, thereby resulting in substantial manufacturing economies.

It would be possible to wait for the center core 10 to become slowly re-inflated by the passage of air through the interstices of the woven belt 16 to the center core 10, but rapid re-inflation with the needle 14 provides more expeditious manufacturing.

After the center core 10 has been re-inflated, the entire cushion is preferably coated with solvent based vinyl, which may be applied by spraying or dipping. This final coating prevents any movement of air to or from the center core 10 either through the adhered joints or through the belt in the manner described above.

The resulting product has all of the desirable qualities set forth above, is economical to produce, is durable in use and is attractive in appearance. It functions satisfactorily as a seat cushion in everyday use, while also serving as a life preserver in the event of an emergency.

The material used to form the outer layer 11 is approximately twenty times as expensive as that used to form the center core 10. The cushion provided by the present invention is equally as satisfactory as one formed entirely of more expensive closed cell foam material. It is also formed into a crown shape economically by deflating and re-inflating the center core in the course of the manufacturing operation.

I claim:

1. A method of forming a floating seat cushion comprising forming a substantially thick center core of open cell foam material, placing on opposite sides of said center core an outer layer of closed cell foam material having a substantially greater length and width than said center core, applying adhesive material between the peripheral portions of said outer layers which extend outwardly beyond the periphery of said center core, pressing said outer layers and center core together to temporarily deflate said center core substantially completely to a flat configuration in order to bring the outwardly extending portions of said outer layers together to adhere said portions into engagement with each other and completely enclose said center core, and re-inflating said center core back to its normal thickness except as restrained by said outer layers, to form said cushion into a convex configuration on the top and bottom of said cushion, said center core remaining inflated thereafter to maintain said cushion permanently in said convex configuration.

2. The method described in claim 1, amd re-inflating said center core by inserting a hollow needle through an outer layer into said center core to permit air to pass from the atmosphere into said center core.

3. The method described in claim 1, and laminating within said cushion a belt comprising a continuous loop extending between one side of said center core and the adjacent side of said other layers to provide a pair of loops which extend a substantial distance outwardly from the opposite side edges of said cushion, and re-inflating said center core by permitting air to pass through the interstices of said belt into said center core.

4. The method described in claim 3, and sealing said belt after re-inflation of said center core to prevent the movement of air or water through the interstices of said belt to or from said center core.

* * * * *